US005176926A

United States Patent [19]

Tung

[11] Patent Number: 5,176,926

[45] Date of Patent: Jan. 5, 1993

[54] SPINNERETS FOR PRODUCING TRILOBAL AND TETRALOBAL FILAMENTS EXHIBITING LOW GLITTER AND HIGH BULK

[75] Inventor: Wae-Hai Tung, Seaford, Del.

[73] Assignee: E. I. Du Pont de Nemours and Company, Wilmington, Del.

[21] Appl. No.: 822,150

[22] Filed: Jan. 17, 1992

Related U.S. Application Data

[62] Division of Ser. No. 758,268, Aug. 27, 1991, Pat. No. 5,108,838.

[51] Int. Cl.[5] ..... B29C 47/12; D01D 5/253

[52] U.S. Cl. ..... 425/461; 264/177.13; 425/464

[58] Field of Search ..... 264/177.1, 177.13; 425/461, 463, 464; 428/397

[56] References Cited

U.S. PATENT DOCUMENTS

| | | | |
|---|---|---|---|
| 2,939,201 | 6/1960 | Holland | 264/177.13 |
| 2,945,739 | 7/1960 | Lehmicke | 264/177.17 |
| 2,959,839 | 11/1960 | Craig | 57/248 |
| 3,097,416 | 7/1963 | McKinney | 428/397 |
| 3,109,220 | 11/1963 | McKinney et al. | 428/397 |
| 3,249,669 | 5/1966 | Jamieson | 264/177.13 |
| 3,418,200 | 12/1968 | Tanner | 264/177.13 |
| 3,994,122 | 11/1976 | Shah | 57/253 |
| 4,245,001 | 1/1981 | Phillips et al. | 428/224 |
| 4,316,924 | 2/1982 | Minemura et al. | 428/397 |
| 4,332,761 | 6/1982 | Phillips et al. | 264/177.13 |
| 4,492,731 | 1/1985 | Bankar et al. | 57/248 |

FOREIGN PATENT DOCUMENTS

| | | | |
|---|---|---|---|
| 623060 | 7/1961 | Canada | 264/177.13 |
| 23616 | 8/1962 | German Democratic Rep. | 264/177.13 |
| 63-235515 | 9/1988 | Japan | 264/177.13 |
| 2-182910 | 7/1990 | Japan . | |
| 938768 | 10/1963 | United Kingdom . | |

*Primary Examiner*—Jay H. Woo
*Assistant Examiner*—James P. Mackey

[57] ABSTRACT

The present invention relates to spinnerets for forming synthetic filaments having a trilobal or tetralobal cross-sectional shape with substantial convex curves, connected by cusps, along the contour of each lobe. The filaments are especially suitable for making carpets which exhibit low glitter, high bulk, and resistance to fibrillation. The spinnerets have a central circular orifice with three or four radial slots radiating from the orifice. Peripheral orifices are located on the longitudinal axis of each radial slot.

4 Claims, 3 Drawing Sheets

SPINNERETS FOR PRODUCING TRILOBAL AND TETRALOBAL FILAMENTS EXHIBITING LOW GLITTER AND HIGH BULK

This is a division of application Ser. No. 07/758,268, filed Aug. 27, 1991, now U.S. Pat. No. 5,108,838.

BACKGROUND OF THE INVENTION

1. Field of the Invention

The present invention relates to synthetic filaments having a trilobal or tetralobal cross-sectional shape with substantial convex curves, connected by cusps, along the contour of each lobe. The filaments are especially suitable for making carpets which exhibit low glitter, high bulk, and resistance to fibrillation.

2. Description of the Related Art

Fibers, or filaments, having trilobal and tetralobal cross-sections have been widely used for carpet yarns due to their bulk and covering power advantages over fibers having round or ribbon cross-sections. However, conventional trilobal and tetralobal filaments contain lobes having cross-sectional contours which are generally flat, or only slightly concave or convex. As a result, at certain viewing angles, a specular reflection from these fiber surfaces creates a "glittering" and frosty appearance on the carpet yarns which is objectionable to many carpet buyers.

By the term, "glittering", it is meant the specks of light perceived on yarns when intense light is directed at the yarn. This is due to minute fiber sections acting as mirrors or reflecting prisms. The term, "glittering", should not be confused with the term, "luster". By the term, "luster", it is meant the overall glow of the fiber from reflected light. Fibers are commonly referred to as having a bright or dull luster, but may or may not be free of glitter.

Examples of trilobal and tetralobal fibers having a high degree of glitter, or sparkle, are respectively disclosed by Bankar et al., U.S. Pat. No. 4,492,731, and McKinney, U.S. Pat. No. 3,109,220. When such high glitter fibers are dyed or pigmented, specular reflection gives the impression that the fiber color is lighter than its true color. Thus, additional dye or pigment is required to compensate for the reflective properties of the fibers. Furthermore, specular reflection is especially visible in highly crimped yarns which are needed to confer high bulk and covering power on premium grade carpets.

Those skilled in the art have proposed many different ways to reduce specular reflection from the surface of fibers.

For example, filaments having round cross-sections typically exhibit less specular reflection and have a more subdued luster. However, due to bulk and covering power deficiencies, these fibers are not widely chosen for use in carpets.

It is also known to add various delusterants, such as titanium dioxide, to the polymer spinning dopes when preparing trilobal and tetralobal fibers. Although these fibers show a more subdued luster, they also have an undesirable chalky appearance. a crimped polyamide staple filament mixture comprising Shah, U.S. Pat. No. 3,994,122, discloses 40–60% by weight of trilobal filaments having a modification ratio within the range of 1.6–1.9, and 40–60% by weight of trilobal filaments having a modification ratio within the range of 2.2–2.5. The filaments provide high bulk, high luster without undesirable sparkle and glitter, and improved resistance to soiling.

Craig, U.S. Pat. No. 2,959,839, discloses making ribbon-like filaments from a series of unconnected round spinneret orifices arranged in a zig-zag pattern. The filaments have corrugated surfaces and exhibit reduced glittering.

Although such conventional filaments, as described above, have been somewhat effective in reducing specular reflection in carpets, there is a need for trilobal and tetralobal filaments which exhibit even lower glitter, while also providing high bulk. The filaments of the present invention demonstrate an improved combination of low glitter, high bulk, and resistance to fibrillation in the finished carpet.

SUMMARY OF THE INVENTION

This invention relates to synthetic filaments having a trilobal or tetralobal cross-section with substantial convex curves, connected by cusps, along the contour of each lobe. The filaments are essentially free of flat surfaces. Each lobe has 2 to 20 curvatures per lobe, and the filaments have a modification ratio of 1.2 to 4.5. Suitable synthetic polymers include polyamides, such as nylon 66 and nylon 6, polyesters, such as polyethylene terephthalate, polyolefins, such as polypropylene, and polyacrylonitrile. Preferably, nylon 66 is used. The filaments may be in the form of a crimped continuous filament yarn, or a crimped staple fiber yarn. The yarns may be used to form carpets which exhibit low glitter, high bulk, and resistance to fibrillation.

The invention also includes spinnerets for producing such fibers. The spinnerets are composed of a plate having upper and lower surfaces connected by a segmented capillary. The segmented capillary includes a central circular orifice with three substantially equally spaced, equidimensional, radial slots, radiating from said orifice. There is also at least one peripheral orifice substantially centered on the longitudinal axis of each slot. In one embodiment, there are two peripheral orifices along each slot. In addition, the diameter of the central orifice may be larger, or equal to the diameter of each peripheral orifice. The ratio of the diameter of a first peripheral orifice to the width of a radial slot is greater than or equal to 3.5:1. The ratio of the diameter of the central orifice to the width of a radial slot is greater than or equal to 6:1.

In another embodiment, there are four radial slots radiating from the central orifice, and at least one peripheral orifice is substantially centered on the longitudinal axis of each slot.

DETAILED DESCRIPTION OF THE INVENTION

The filaments of this invention are generally prepared by spinning molten polymer or polymer solutions through spinneret capillaries which are designed to provide the desired trilobal or tetralobal cross-section of the filament.

The filaments may be prepared from synthetic, thermoplastic polymers which are melt-spinnable. These polymers include, for example, polyolefins such as polypropylene, polyamides such as polyhexamethylenediamine adipamide (nylon 66) and polycaprolactam (nylon 6), and polyesters such as polyethylene terephthalate. Copolymers, terpolymers, and melt blends of such polymers are also suitable. Polymers which form solutions, such as polyacrylonitrile, may also be used. These polymer solutions are dry-spun into filaments.

Generally, in the melt spinning process, the molten polymer is extruded into air or other gas, or into a suitable liquid, where it is cooled and solidified. Suitable quenching gasses and liquids include, for example, air at room temperature, chilled air, and water. In the dry spinning process, the polymer solution is extruded as a continuous stream into a heated chamber to remove the solvent; thus, a solid filament is formed. It is recognized that the specific spinning conditions, e.g., viscosity, rate of extrusion, quenching, etc. will vary depending upon the polymer used. The polymer spinning dopes may also contain conventional additives, such as antioxidants, dyes, pigments, antistatic agents, ultraviolet (UV) stabilizers, etc.

Figure 4:
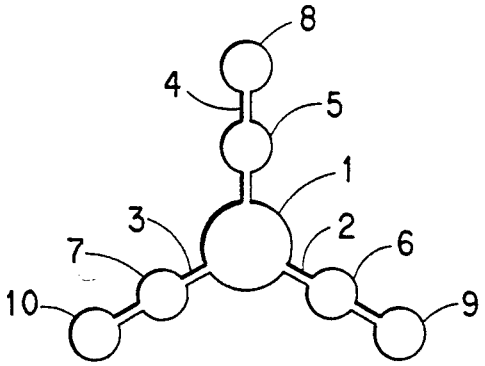
FIG. 4 is a face view of a spinneret capillary of the present invention, comprising a central circular orifice, three substantially equally spaced radial slots radiating from the central orifice, and two peripheral circular orifices along the length of each slot.

Referring to FIG. 4, an example of a suitable spinneret capillary for forming the filaments of this invention is illustrated.

Figure 5:
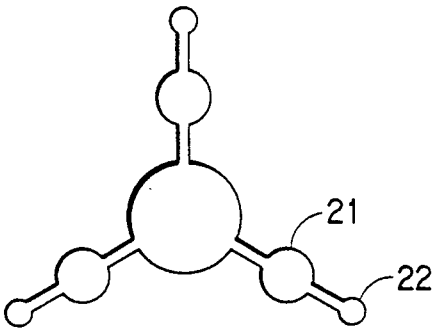
FIG. 5 is a face view of a spinneret capillary of the present invention, wherein the two peripheral orifices along each slot have different dimensions.
Figure 6:
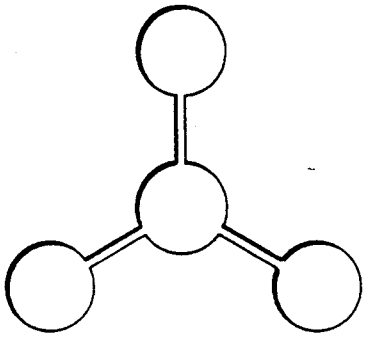
FIG. 6 is a face view of a spinneret capillary of the present invention, wherein there is only one peripheral orifice along each slot and the diameter of each one is approximately equal to the diameter of the central orifice.
Figure 7:
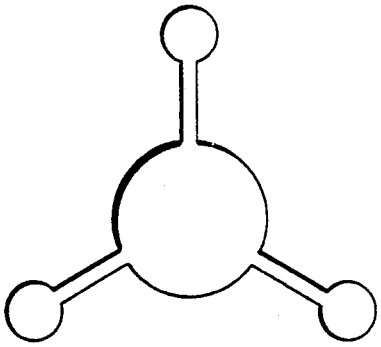
FIG. 7 is a face view of a spinneret capillary of the present invention, wherein there is only one peripheral orifice along each slot and the diameter of each one is smaller than the diameter of the central orifice.

The capillary includes a central circular orifice (1) with three substantially equally spaced radial slots (2), (3), and (4) radiating from the central orifice (1). Along each slot, there are one or more peripheral circular orifices. FIG. 4 shows three "first" peripheral orifices (5), (6), and (7), and three "second" peripheral orifices (8), (9), and (10). By the term, "first peripheral orifice(s)" it is meant the orifices located away from the center, which are adjacent to the central orifice. By the term "second peripheral orifice(s)", it is meant the orifices located away from the center, which are adjacent to the first peripheral orifices. All of the peripheral circular orifices are substantially centered on the longitudinal axis of their corresponding slot. The peripheral orifices may have substantially equal dimensions, as shown in FIGS. 4, 6, and 7, or may have unequal dimensions, as shown in FIG. 5. The radial slots also have substantially equal dimensions.

The orifices and slots of the spinneret capillary typically have the following dimensions. The central circular orifice may have a diameter in the range of about 0.01 to 0.02 inches, while the peripheral circular orifices may have a diameter in the range of about 0.005 to 0.02 inches. Each slot typically has a length of about 0.02 to 0.03 inches, and a width of about 0.002 to 0.003 inches.

It is necessary for both the orifices and slots of the spinneret capillary to meet the following criteria:

$$A/B \geqq 3.5, \text{ and } C/B \geqq 6$$

where

C = diameter of the central orifice;

B = width of the connecting radial slots; and

A = diameter of a first peripheral orifice.

Filaments spun from capillaries having dimensions other than the above-stated ratios tend to have cross-sections which cause high glitter or are susceptible to fibrillation under traffic.

However, it is understood that specific dimensions and ratios, within the above ranges, may vary depending upon such factors as polymer type, viscosity, and quench medium. High viscosity polymers and water-quench spinning require lower orifice diameter to radial slot width ratios, than low viscosity polymers and air-quench spinning. The desired "modification ratio" for the resulting filaments is also an important factor. By the term, "modification ratio" (MR), it is meant the ratio of the radius of a circle which circumscribes the filament cross-section to the radius of the largest circle which can be inscribed within the filament cross-section, as disclosed in Holland, U.S. Pat. No. 2,939,201.

The central and peripheral orifices may have equal dimensions as shown in FIG. 6. However, as shown in FIGS. 4, 5, and 7, the central circular orifice preferably has a diameter larger than the peripheral circular orifices in order to better strengthen the resulting fiber. In a particularly desirable configuration, the diameter of the central orifice is larger than the diameter of a first peripheral orifice (21) which, in turn, is larger than the diameter of a second peripheral orifice (22), as shown in FIG. 5. The larger diameter of the central orifice and smaller diameters of the peripheral orifices at the extremities provide for a relatively low modification ratio in the filament.

Figure 8:
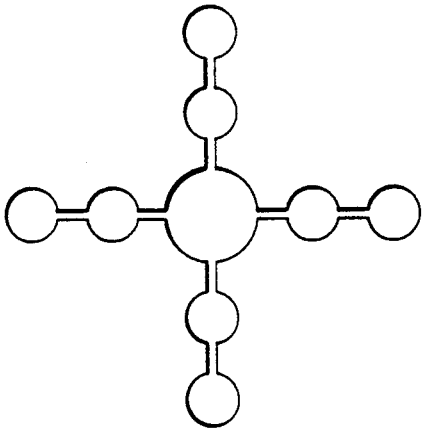
FIG. 8 is a face view of a spinneret capillary of the present invention, comprising a central circular orifice, four substantially equally spaced radial slots radiating from the central orifice, and two peripheral circular orifices along the length of each slot.
Figure 9:
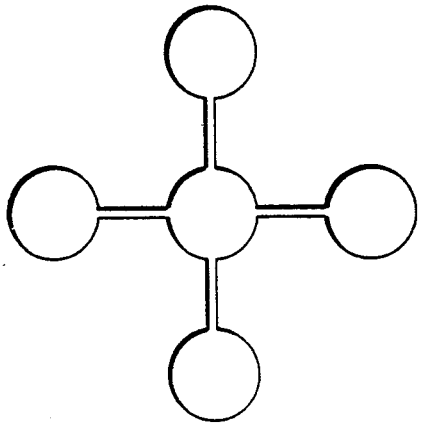
FIG. 9 is a face view of a spinneret capillary of the present invention having four radial slots, wherein there is only one peripheral orifice along each slot.

In another embodiment, as shown in FIGS. 8 and 9, the capillary includes a central circular orifice with four, rather than three, substantially equally spaced radial slots radiating from the central orifice. Along each slot, there are one or more peripheral circular orifices. These capillaries may produce tetralobal filaments in accordance with this invention.

It is also understood that the above-described spinneret capillaries may be modified to provide filaments having cross-sections, as shown in FIGS. 4A–7A. For example, the orifices may have a square, pentagonal, or hexagonal shape, provided that the polymer has sufficient surface tension to form cross-sections, as shown in FIGS. 4A–7A. As shown in FIGS. 4A–7A, it is critical that the resulting filaments be essentially free of flat surfaces.

It is also critical that the central and peripheral orifices be connected by slots in order that the polymer streams fuse together before passing through the bottom of the capillary. This provides for the trilobal and tetralobal filaments having high bulk as well as low glitter.

In contrast, conventional techniques for producing ribbon-like filaments, as discussed in the aforementioned Craig, U.S. Pat. No. 2,959,839 and Jamieson, U.S. Pat. No. 3,249,669, involve fusing the polymer stream above the spinneret capillary. However, the degree of polymer coalescence depends upon such conditions as the viscosity and temperature of the polymer, the spacing of the orifices, and the quenching conditions. For example, if the viscosity is low and the polymer temperature is high, the streams will fuse together strongly, but the cusps will be shallow and the fiber surface will exhibit high glitter. On the other hand, if the viscosity is high and the polymer temperature is low, the fiber surface will exhibit low glitter. However, the streams will have fused together so poorly that the resulting filaments will readily separate and fibrillate during texturing, or under normal wear conditions, giving a fuzzy carpet surface.

Figure 4A:
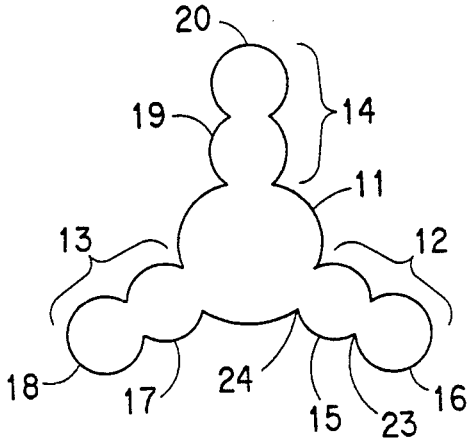
FIG. 4A is a cross-sectional view of a filament spun through capillaries of the type shown in FIG. 4.

The polymer flows through the specifically designed orifices and slots to produce a corresponding filament as shown, for example, in FIG. 4A. The filaments have a central circular member (11) and three substantially equally spaced lobes (12), (13), and (14). These essentially symmetrical lobes, or arms, are integrally joined at a central point. Each lobe includes one or more circular segments (15), (16), (17), (18), (19), and (20) having cusps (23) and (24) at their junctions.

The trilobal and tetralobal filaments of this invention have a modification ratio of about 1.2 to 4.5, and are further characterized by the presence of substantial convex curves, connected by cusps, along the contour of each lobe. These bulges and depressions which form along the filament's contour can be measured in terms of "curvature reversals per lobe." By the term, "curvature reversals per lobe", it is meant the fixed points on a lobe of the filament, where a point tracing the curve of the lobe would reverse its direction of motion. Referring to FIG. 4A, these curvature reversals are identified as cusps (23) and (24). The filaments generally have about 2 to 20 curvature reversals per lobe, and are essentially free of flat surfaces. It is believed that the low glittering, high bulk, and resistance to fibrillation capabilities of the filaments in this invention are due to this unique structure.

The filaments are generally uniform in cross-section along their length and may be used for several different applications, including carpet, textile, or non-woven uses. For carpet applications, the filaments may be uncrimped, or crimped in order to provide additional bulk to the carpet yarn. The carpet yarn may be in the form of bulked continuous filament (BCF) yarn or staple fiber yarn. It is also recognized that the filaments of this invention may be blended with each other, or with other filaments to form filament blends. The crimping, or texturing, of the yarn may occur by techniques known in the art including, for example, hot air-jet bulking, gear-crimping, or stuffer-box methods. When the fiber of this invention is primarily intended for use as carpet yarn, the denier per filament (dpf) will preferably be in the range of 6 to 25, while the total yarn denier will be at least about 500.

The carpet yarns are then tufted into a carpet backing material by techniques known in the art. The yarn may be inserted as loops to form loop-pile carpets. For cut-pile carpets, the loops may be cut to form substantially parallel vertical tufts which are then evenly sheared to a desired height. The carpets made from the yarns of this invention are essentially free of glitter, have high bulk, and are resistant to fibrillation.

Testing Methods

Carpet Glitter and Bulk Ratings

The degrees of bulk and glitter for different cut-pile carpet samples were visually compared in a side-by-side comparison without knowledge of which carpets were made with which yarns. The carpets were examined by a panel of people familiar with carpet construction and surface texture.

Carpet samples composed of round cross-section fibers were chosen as reference points and given a rating of no glitter and low bulk. For bulk, the remaining samples were given a subjective rating of either low, medium, or high. For glitter, the remaining samples were given a subjective rating of none, low, medium, or high.

Relative Viscosity

The relative viscosity (RV) of nylon 66 was measured by dissolving 5.5 grams of nylon 66 polymer in 50 cc of formic acid. The RV is the ratio of the absolute viscosity of the nylon 66/formic acid solution to the absolute viscosity of the formic acid. Both absolute viscosities were measured at 250° C.

EXAMPLES

Examples 1–7

In the following Examples, nylon 66 filaments having various cross-sections were produced. The nylon 66 filaments were spun from different spinnerets. Each spinneret had 160 capillaries of a specific design, as shown in FIGS. 1–7.

The nylon 66 polymer used for all of the examples was a bright polymer. The polymer spin dope did not contain any delusterant and had a relative viscosity (RV) of 68±3 units. The polymer temperature before the spinning pack was controlled at about 290°–1° C., and the spinning throughput was 70 pounds per hour. The polymer was extruded through the different spinnerets and divided into two 80 filament segments The capillary dimensions for the spinnerets are described below. The molten fibers were then rapidly quenched in a chimney, where cooling air at 9° C. was blown past the filaments at 300 cubic ft./min (0.236 cubic m/sec). The filaments were pulled by a feed roll rotating at a surface speed of 800 yd./min (732 m/min) through the quench zone and then were coated with a lubricant for drawing and crimping. The coated yarns were drawn at 2197 yds./min (2.75×draw ratio) using a pair of heated (220° C.) draw rolls. The yarns were then forwarded into a dual-impingement bulking jet (240° C. hot air), similar to that described in Coon, U.S. Pat. No. 3,525,134, to form two 1200 denier, 15 denier per filament (dpf) yarns.

The spun, drawn, and crimped bulked continuous filament (BCF) yarns were cable-twisted to 5.75 turns per inch (tpi) on a cable twister and heat-set on a Superba heat-setting machine at the standard process conditions for nylon 66 BCF yarns. The test yarns were then tufted into 40 oz./sq. yd., ⅝ inch pile height carpets on a ⅛ inch gauge cut pile tufting machine. The tufted carpets were dyed in a range dyer into medium mauve color carpets. The carpet aesthetics were assessed by a panel of experts and the results are shown in Table I.

EXAMPLE 1 (COMPARATIVE)

Figure 1:
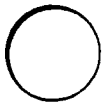
FIG. 1 (PRIOR ART)
FIG. 1 is a face view of a round spinneret capillary of the prior art.
Figure 1A:
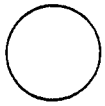
FIG. 1A (PRIOR ART)
FIG. 1A is a cross-sectional view of a filament spun through capillaries of the type shown in FIG. 1.

Filaments having a round cross-section, as shown in FIG. 1A, were made using the above-described process. The filaments were spun through a spinneret capillary, as shown in FIG. 1, having a round orifice of 0.010 inches in diameter.

EXAMPLE 2 (COMPARATIVE)

Figure 2:
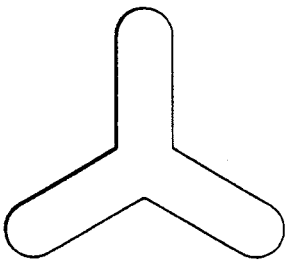
FIG. 2 (PRIOR ART)
FIG. 2 is a face view of a trilobal spinneret capillary of the prior art.
Figure 2A:
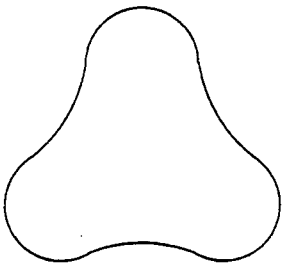
FIG. 2A (PRIOR ART)
FIG. 2A is a cross-sectional view of a filament spun through capillaries of the type shown in FIG. 2.

Filaments having a trilobal cross-section, as shown in FIG. 2A, were made using the above-described process The filaments were spun through a spinneret capillary, as shown in FIG. 2, having three integrally joined arms (lobes) which were essentially symmetrical. The arms had a width of 0.008 inches and a length of 0.017 inches.

EXAMPLE 3 (COMPARATIVE)

Figure 3:
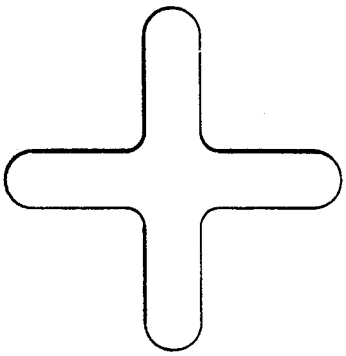
FIG. 3 (PRIOR ART)
FIG. 3 is a face view of a tetralobal spinneret capillary of the prior art.
Figure 3A:
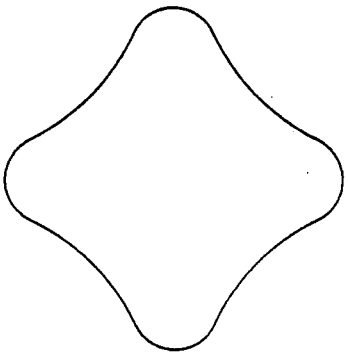
FIG. 3A (PRIOR ART)
FIG. 3A is a cross-sectional view of a filament spun through capillaries of the type shown in FIG. 3.

Filaments having a tetralobal cross-section, as shown in FIG. 3A, were made using the above-described process. The filaments were spun through a spinneret capillary, as shown in FIG. 3, having four integrally joined arms (lobes) which were essentially symmetrical. The arms had a width of 0.010 inches and a length of 0.025 inches.

EXAMPLE 4

Filaments having a trilobal cross-section, as shown in FIG. 4A, were made using the above-described process. The filaments were spun through a spinneret capillary, as shown in FIG. 4, having the following dimensions. The central orifice (1) had a diameter of 0.020 inches, and the slots (2–4) had widths of 0.002 inches. The first and second peripheral orifices (5–10) had diameters of 0.015 inches. The distance from the center point of a first peripheral orifice, e.g., (5), along the slot, to the center point of a second peripheral orifice, e.g., (8) was 0.0210 inches. The distance from the center point of the central orifice, along the slot, to the center point of the first peripheral orifices was 0.0235 inches.

EXAMPLE 5

Figure 5A:
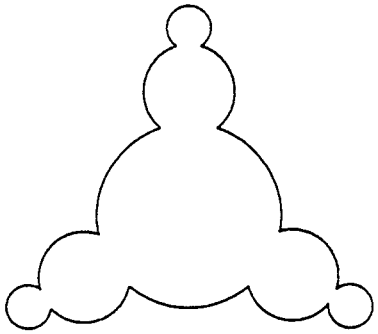
FIG. 5A is a cross-sectional view of a filament spun through capillaries of the type shown in FIG. 5.

Filaments having a trilobal cross-section, as shown in FIG. 5A, were made using the above-described process. The filaments were spun through a spinneret capillary., as shown in FIG. 5, having the following dimensions. The central orifice had a diameter of 0.0170 inches, and the slots had widths of 0.0025 inches. The first peripheral orifice, e.g., (21) had a diameter of 0.0090 inches, and the second peripheral orifice, e.g., (22) had a diameter of 0.0070 inches. The distance from the center point of the first peripheral orifice, along the slot, to the center point of the second peripheral orifice was 0.0255 inches. The distance from the center point of the central orifice, along the slot, to the center point of the first peripheral orifices was 0.0285 inches.

EXAMPLE 6

Figure 6A:
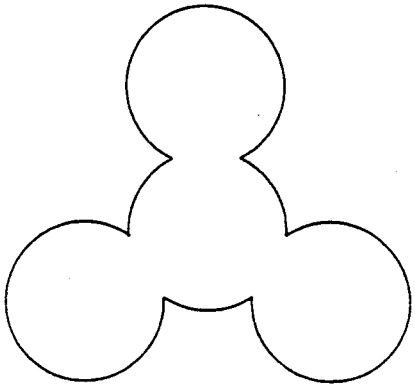
FIG. 6A is a cross-sectional view of a filament spun through capillaries of the type shown in FIG. 6.

Filaments having a trilobal cross-section, as shown in FIG. 6A, were made using the above-described process. The filaments were spun through a spinneret capillary, as shown in FIG. 6, having the following dimensions. The central orifice had a diameter of 0.0150 inches, and the slots had widths of 0.0025 inches. The peripheral orifices had diameters of 0.0150 inches. The distance from the center point of the central orifice to the center point of the peripheral orifices was 0.0285 inches.

EXAMPLE 7

Figure 7A:
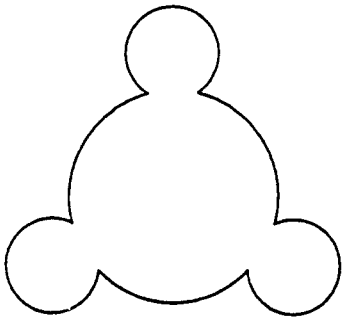
FIG. 7A is a cross-sectional view of a filament spun through capillaries of the type shown in FIG. 7.

Filaments having a trilobal cross-section, as shown in FIG. 7A, were made using the above-described process. The filaments were spun through a spinneret capillary, as shown in FIG. 7, having the following dimensions. The central orifice had a diameter of 0.0170 inches, and the slots had widths of 0.0025 inches. The peripheral orifices had a diameter of 0.0090 inches. The distance from the center point of the central orifice to the center point of the peripheral orifices was 0.0285 inches.

TABLE I

| Example | Cross-section | Glitter | Bulk |
|---|---|---|---|
| 1 (Comparative) | Round | None | Low |
| 2 (Comparative) | 1.7 MR* trilobal | High | Medium |
| 3 (Comparative) | 1.5 MR tetralobal | High | Medium |
| 4 | 2.6 MR trilobal | None | High |
| 5 | 2.4 MR trilobal | None | High |
| 6 | 2.0 MR trilobal | Low | High |
| 7 | 1.6 MR trilobal | Low | Medium-High |

*MR—Modification Ratio

I claim:

1. A spinneret, comprising:

a) a plate having upper and lower surfaces connected by a segmented capillary, and b) the segmented capillary comprising a central circular orifice and three substantially equally spaced, equidimensional radial slots radiating from said central circular orifice, wherein two peripheral circular orifices are substantially centered on the longitudinal axis of each radial slot, the ratio of the diameter of each peripheral orifice located adjacent to the central orifice, to the width of each radial slot is greater than or equal to 3.5:1, and the ratio of the diameter of the central orifice to the width of each radial slot is greater than 6:1.

2. The spinneret of claim 1, wherein the diameter of the central circular orifice is larger than the diameter of each peripheral circular orifice.

3. The spinneret of claim 1, wherein the diameter of the central circular orifice is substantially equal to the diameter of each peripheral circular orifice.

4. A spinneret, comprising:

a) a plate having upper and lower surfaces connected by a segmented capillary, and b) the segmented capillary comprising a central circular orifice and four substantially equally spaced, equidimensional radial slots radiating from said central circular orifice, wherein two peripheral circular orifices are substantially centered on the longitudinal axis of each radial slot, the ratio of the diameter of each peripheral orifice located adjacent to the central orifice, to the width of each radial slot is greater than or equal to 3.5:1, and the ratio of the diameter of the central orifice to the width of each radial slot is greater than 6:1.

* * * * *